US005937801A

United States Patent [19]

Davis

[11] Patent Number: 5,937,801

[45] Date of Patent: Aug. 17, 1999

[54] OIL TEMPERATURE MODERATOR FOR AN INTERNAL COMBUSTION ENGINE

[75] Inventor: Richard A. Davis, Mequon, Wis.

[73] Assignee: Brunswick Corporation, Lake Forest, Ill.

[21] Appl. No.: 09/127,242

[22] Filed: Jul. 31, 1998

[51] Int. Cl.[6] ..... F01P 11/08

[52] U.S. Cl. ..... 123/41.33; 123/196 AB; 60/320; 440/89

[58] Field of Search ..... 123/41.01, 41.02, 123/41.08, 41.31, 41.33, 41.44, 196 AB; 60/320, 321; 184/104.2; 440/88, 89, 900

[56] References Cited

U.S. PATENT DOCUMENTS 4,498,875 2/1985 Watanabe ..... 440/88
5,769,038 6/1998 Takahashi et al. ..... 123/41.82 R

*Primary Examiner*—Willis R. Wolfe
*Assistant Examiner*—Brian Hairston
*Attorney, Agent, or Firm*—William D. Lanyi

[57] ABSTRACT

A cooling system is provided for an outboard motor or other marine propulsion system which causes cooling water to flow in intimate thermal communication with the oil pan of the engine by providing a controlled volume of cooling water at the downstream portion of the water path. As cooling water flows from the outlet of the internal combustion engine, it is caused to pass in thermal communication with the oil pan. Certain embodiments also provide a pressure activated valve which restricts the flow from the outlet of the internal combustion engine to the space near the oil pan. One embodiment of the cooling system also provides a dam within the space adjacent to the outer surface of the oil pan to divide that space into first and second portions. The dam further slows the flow of water as it passes in thermal communication with the oil pan.

17 Claims, 6 Drawing Sheets

OIL TEMPERATURE MODERATOR FOR AN INTERNAL COMBUSTION ENGINE

BACKGROUND OF THE INVENTION

1. Field of the Invention

The present invention is generally related to a system for moderating the temperature of lubricating oil, between low and high limits, for an internal combustion engine and, more particularly, a system which improves the flow of coolant in thermal communication with an oil pan in a marine propulsion system.

2. Description of the Prior Art

It is well known that in certain applications, including many types of marine propulsion systems, internal combustion engines must be water cooled. With marine propulsion systems, the internal combustion engine can be cooled by using water that is drawn from a body of water in which the propulsion system is operated. It is also well know that, in marine propulsion systems, hot exhaust gases are typically conducted from the internal combustion engine along a path that passes through the driveshaft housing in proximity with the oil pan of the engine.

In a typical application of an internal combustion engine, such as a four cycle engine, it is necessary to assure that the lubricating oil is not overheated. Under some conditions, the lubricating oil of a four cycle engine can be cooled below desirable operating temperatures. This is most likely in circumstances where the oil pan of the engine is allowed to be placed in direct thermal contact with water drawn from the body of water in which the marine propulsion system is operated. This can occur in at least two ways. First, when a marine vessel is stationary in a body of water, the weight of the engine often lowers the location of the oil pan to a position in which it is placed in close thermal relationship with the body of water. In other situations, the cooling system of the internal combustion engine may draw cold water from the body of water and cause it to flow in thermal communication with the oil pan before the water flows through the cooling passages of the internal combustion engine. If the temperature of the water in the body of water is sufficiently low, it can cool the oil to a temperature below its most advantageous operating temperature. This can raise the viscosity of the oil and possibly cause the lubricating system to operate at less than efficient levels. Furthermore, this condition can cause fuel condensation in the oil reservoir and increase the volume of the oil.

Many different systems have been developed to address the issues of cooling the exhaust conduit of a marine propulsion system, storing lubricating oil in a reservoir, preventing the overheating of the lubricating oil, and directly cooling the exhaust as it emerges from the internal combustion engine.

U.S. Pat. No. 5,487,687, which issued to Idzikowski et al on Jan. 30, 1996, discloses a midsection and cowl assembly for an outboard marine drive. The marine drive has a midsection between the upper power head and the lower gear case and has a removable midsection cowl assembly which includes first and second sections. The midsection housing includes an oil sump in one embodiment and further includes an exhaust passage encircled by cooling water and partially encircled by engine oil for muffling the engine exhaust noise. The midsection housing also has an oil drain arrangement providing complete and clean oil draining while the outboard drive is mounted on a boat and in the water, wherein the operator can change oil without leaving the confines of the boat and entering the water.

U.S. Pat. No. 5,232,387, which issued to Sumigawa on Aug. 3, 1993, describes an exhaust device for a four cycle outboard motor. The arrangement is provided for the lubricating, cooling and exhaust systems of a four cycle outboard watercraft motor. Coolant is drawn from the body of water within which the watercraft is operated for circulation through the engine cooling system. Subsequently, the coolant is brought into proximity with an exhaust pipe which extends downwardly from the engine within the encasing member. After passing downwardly along the exhaust pipe, the coolant is finally directed towards an exhaust gas expansion chamber and a cooling water jacket provided around the expansion chamber. In order to prevent any of the cooling water from splashing back up against an oil reservoir, which is also located within the casing, a cover is provided across the tops of the expansion chamber and its accompanying cooling water jacket. Cooling water or air may fill the voids separating the various components contained within the encasing. The arrangement is particularly effective in preventing the corrosion of the oil reservoir housing due to back splashed coolant when the watercraft is operated in salt water. It cools the components contained within the encasing and it minimizes heat transfers from higher temperature operating components to lower temperature operating components.

U.S. Pat. No. 4,498,875, which issued to Watanabe on Feb. 12, 1985, describes an outboard motor which comprises a water cooled, four cycle internal combustion engine. In each of two embodiments, an arrangement is provided that offers a compact nature and which uses the coolant delivered to the engine for cooling the oil in the oil pan. In addition, an arrangement is provided whereby the exhaust pipe may pass through the oil pan and yet avoid significant heat transfer from the exhaust system to the lubricating system. In each embodiment of the invention, coolant is delivered to this clearance for further cooling the exhaust system. In one embodiment of the invention, an arrangement is provided for limiting the discharge of coolant from the clearance so as to maintain a level of coolant around the exhaust pipe.

U.S. Pat. No. 4,015,429, which issued to Pichl on Apr. 5, 1977, discloses an outboard motor for reducing exhaust gas pollutants. The outboard motor has an engine located above the water level, a lower unit extending downwardly from the engine, and an exhaust gas tube within the lower unit with its lower end positioned below the water level. Laterally enclosing the closing gas tube is a liquid jacket and a heat insulating jacket is positioned between the exhaust gas tube and the liquid jacket for maintaining the temperature of the exhaust gases at a level such that an afterburning of any oil residue in the exhaust gases is achieved before the gases are discharged from the exhaust gas tube.

U.S. Pat. No. 5,704,819, which issued to Isogawa on Jan. 6, 1998, describes an oil pan arrangement for a four cycle outboard motor. The outboard motor has a high performance twin overhead cam four cycle internal combustion engine. The oil reservoir for the engine is disposed in a driveshaft housing below the engine and an oil pump is driven by the lower end of the engine crankshaft for circulating the oil from the oil tank to the engine. The oil supply system for the engine includes a vertically extending main gallery and a drain passage which extend in parallel side-by-side relationship and which are disposed over the oil tank for ease of oil return. The exhaust and cooling system for the engine is configured so as to minimize heat transfer between the exhaust system and the lubricating system and to maintain a compact assembly.

U.S. Pat. No. 5,522,351, which issued to Hudson on Jun. 4, 1996, discloses an internal combustion engine temperature control system. It comprises a liquid to liquid heat exchanger incorporated into the body of an internal combustion engine. A first cooling liquid, such as oil, is circulating through passages in the engine block and along one side of a heat conducting wall integral with the engine block. A second cooling liquid, such as water, is circulated through a cooling water passage adjacent to the heat conducting wall to remove heat from the first cooling liquid. It may also be pumped through other passages within the engine block for the purpose of cooling the engine.

U.S. Pat. No. 5,752,866, which issued to Takahashi et al on May 19, 1998, describes a lubricating and crankcase ventilating system for a four cycle outboard motor. The outboard motor has a high performance V-type twin overhead cam four cycle internal combustion engine. The oil reservoir for the engine is disposed in a driveshaft housing below the engine and an oil pump is driven by the lower end of the engine crankshaft for circulating the oil from the oil tank to the engine. The exhaust and cooling systems for the engine are configured so as to minimize heat transfer between the exhaust system and the lubricating system. They are also configured to maintain a compact assembly. The oil supply system for the engine includes a vertically extending main gallery and a drain passage which extend in parallel side-by-side relationship with each other. They are disposed over the oil tank for ease of oil return.

U.S. Pat. No. 5,778,847, which issued to Takahashi et al on Jul. 14, 1998, discloses a four cycle outboard motor. The oil reservoir for the engine of the outboard motor is disposed in a driveshaft housing below the engine. An oil pump is driven by the engine crankshaft and circulates the oil from the oil tank to the engine. The oil supply system for the engine includes a vertically extending main gallery and a drain passage which extend in parallel side-by-side relationship with each other. The exhaust and cooling system for the engine is configured so as to minimize heat transfer between the exhaust system and the lubricating system and also to maintain a compact assembly.

All of the patents described above are hereby explicitly incorporated by reference in this description.

Many different techniques for cooling lubricating oil are well known to those skilled in the art. However, the known techniques do not address the problem of lubricating oil which can be excessively cooled, either by the engine cooling system or by thermal communication with a body of water, such as a lake, in which the marine propulsion system is used. It would therefore be significantly beneficial if a temperature control system could be provided in which the temperature of the oil reservoir for a marine propulsion device could be maintained within a preselected range that prevents the lubricating oil from either being overheated or overcooled.

SUMMARY OF THE INVENTION

A preferred embodiment of the present invention provides an internal combustion engine which comprises a water cooling circuit extending through a portion of an engine block of the internal combustion engine and an oil reservoir for holding a quantity of lubricating oil for use by the internal combustion engine. An inlet of the water cooling circuit is connected in fluid communication with a source of water, such as the body of water in which the internal combustion engine is operated, and an outlet of the water cooling circuit is positioned to direct a stream of water through a space which is adjacent to an outer surface of the oil reservoir after the water has passed through the engine block. In addition, a flow restrictor is disposed downstream of at least a portion of the space in order to slow the passage of the stream of water through the space.

In a particular preferred embodiment of the present invention, the space is disposed between the oil reservoir and an exhaust gas conduit of the internal combustion engine but this is not required in all embodiments. The space can be generally annular in shape and disposed around the exhaust gas conduit. The oil reservoir can also be generally annular in shape and disposed around the space. The flow restrictor comprises an opening which can direct water to flow in intimate thermal contact with the exhaust gas conduit as it flows out of the space. A pressure relief valve can be disposed within the water cooling circuit in order to prevent water from flowing out of the outlet unless the pressure of the water within the engine block is greater than a preselected magnitude.

A dam can be disposed within the space in order to divide the space into first and second portions, with the first portion initially collecting water flow from the outlet and spilling over into the second portion. The second portion can be connected in fluid communication between the first portion and the flow restrictor.

The internal combustion engine can be a component of a marine propulsion device and the marine propulsion device can be an outboard motor.

The primary advantage of the present invention is that it slows the passage of water through the space adjacent to the oil pan so that there is increased thermal communication between the oil pan and the water passing through the space. This increased thermal communication serves two beneficial purposes, depending on the temperature of the oil. If the oil is extremely cold, due to significant thermal communication between the oil and a body of water, the water passing from the outlet of the water cooling circuit will be warmed sufficiently by the engine to raise the temperature of the oil in the oil pan to a more beneficial operating magnitude. If, on the other hand, the oil has been heated by heat transfer from the engine during sustained operation at high speed, the water passing from the outlet of the cooling water circuit will lower the temperature of the oil within the oil pan. As a result, the temperature of oil in the oil pan is maintained between upper and lower temperature thresholds and is kept at an appropriate operating temperature. In addition, a pressure relief valve in the coolant passage leading to the annulus surrounding the exhaust conduit and near the oil reservoir provides the added flexibility of more precisely controlling the flow of cooling water through the system. It maintains the rate of cooling water flow as a function of engine speed or load and permits a more accurate regulation of the oil temperature.

BRIEF DESCRIPTION OF THE DRAWINGS

The present invention will be more fully and completely understood from a reading of the description of the preferred embodiment with conjunction with the drawings, in which.

DESCRIPTION OF THE PREFERRED EMBODIMENT

Figure 1:
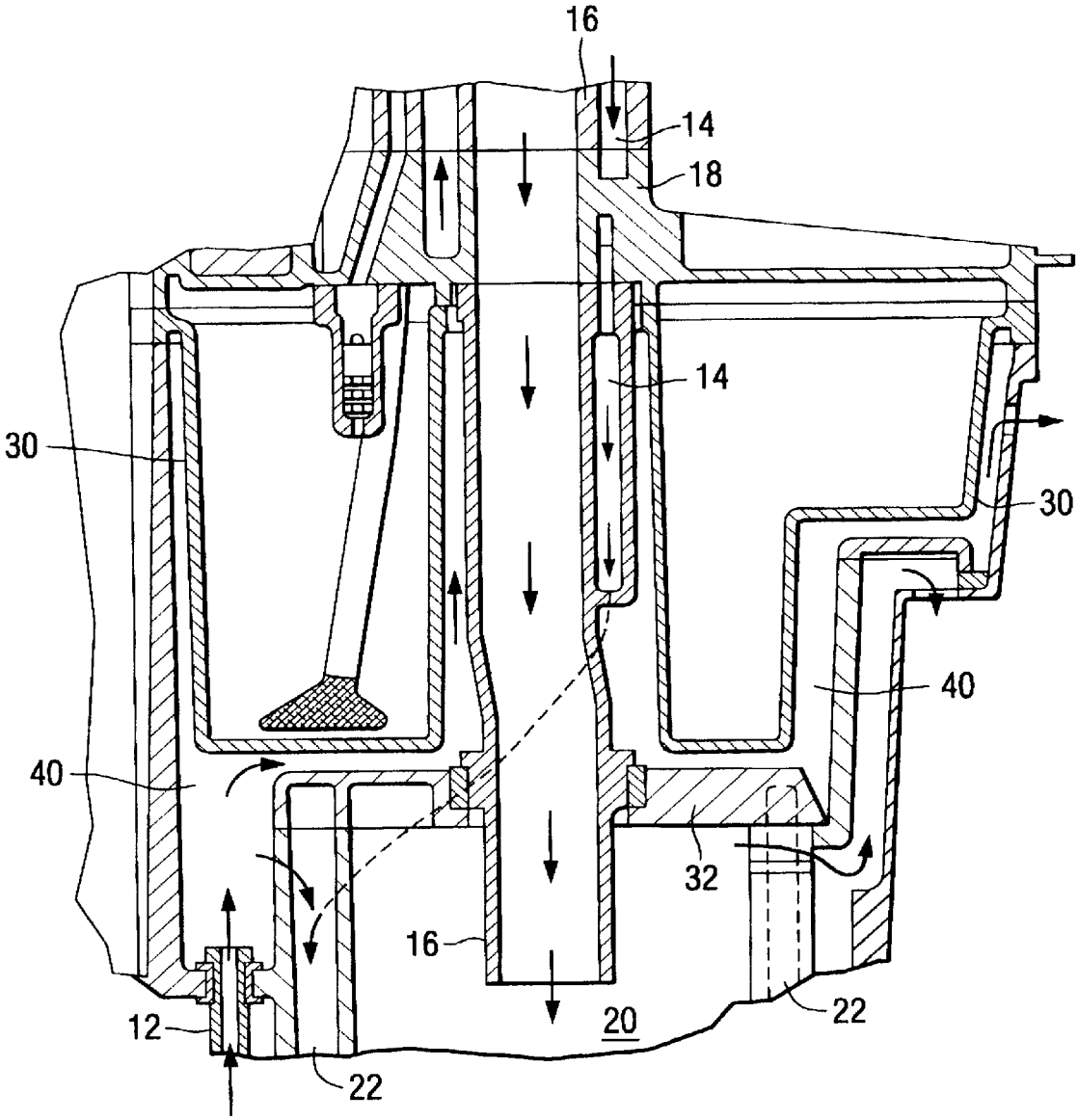
FIG. 1 PRIOR ART
FIGS. 1, 2 and 3 show various prior art cooling systems.

Throughout the description of the preferred embodiment, like components are identified by like reference numerals. In order to understand the operation of the present invention and the advantages provided by it, it is necessary to understand how certain known cooling systems operate. For this purpose, FIG. 1 shows a system that is known to those skilled in the art and described in significant detail in U.S. Pat. No. 5,232,387.

FIG. 1 illustrates a sectional view of a prior art oil storage system which is described in U.S. Pat. No. 5, 232,387. In known systems of this type, the internal combustion engine is provided with a water inlet positioned within the lower unit of the outboard motor that permits water to be drawn from the body of water in which the water path is operating. The water inlet supplies a delivery pipe from which water is drawn by a coolant pump assembly that is typically driven by the driveshaft of the internal combustion engine. The coolant pump is located at a position proximate to the region in which the lower unit is attached to the remainder of the driveshaft housing. This placement of the pump allows for easy access to the coolant pump arrangement for the purpose of servicing the outboard motor. As described in U.S. Pat. No. 5,232,387, the coolant then flows upwardly for delivery to the cooling system of the engine through a water delivery pipe 12. A water passage 14 is formed integrally with the exhaust pipe 16. It curves downwardly around the exhaust pipe 16 in a direction leading to the support plate 18. The coolant water is then passed in proximity to the exhaust gases which pass through the exhaust pipe 16. An outlet is located at the lower end of the water passage 14. Upon exiting the water passage 14 through the outlet, the portion of the coolant water is directed toward the primary expansion chamber 20 and directly contacts the exhaust gases located therein. Another portion of the cooling water is directed toward a water jacket 22 which surrounds the primary expansion chamber 20 in order to cool the outer surface thereof. These various cooling steps utilize the coolant water to help cool the exhaust gases and thereby quiet the operation of the engine. In order to prevent any of the cooling water from contacting the outer surface of the oil pan 30 by way of splashing caused by exhaust pressure or other external forces, the particular known system shown in FIG. 1 comprises a cover 32 is provided across the tops of the water jacket 22 and primary expansion chamber 20.

With continued reference to FIG. 1, it can be seen that the cooling water drawn from a source, such as a lake or other body of water, passes through the water delivery pipe 12 and then fills the space 40 which surrounds the exhaust pipe 16 and the oil pan 30. It should be noted that the water flowing upward through the space 40 fills the space prior to passing upward into the internal combustion engine for purposes of cooling it. Therefore, the water which fills space 40 is at the lowest temperature that it will attain during its total passage through the cooling system.

Figure 2:
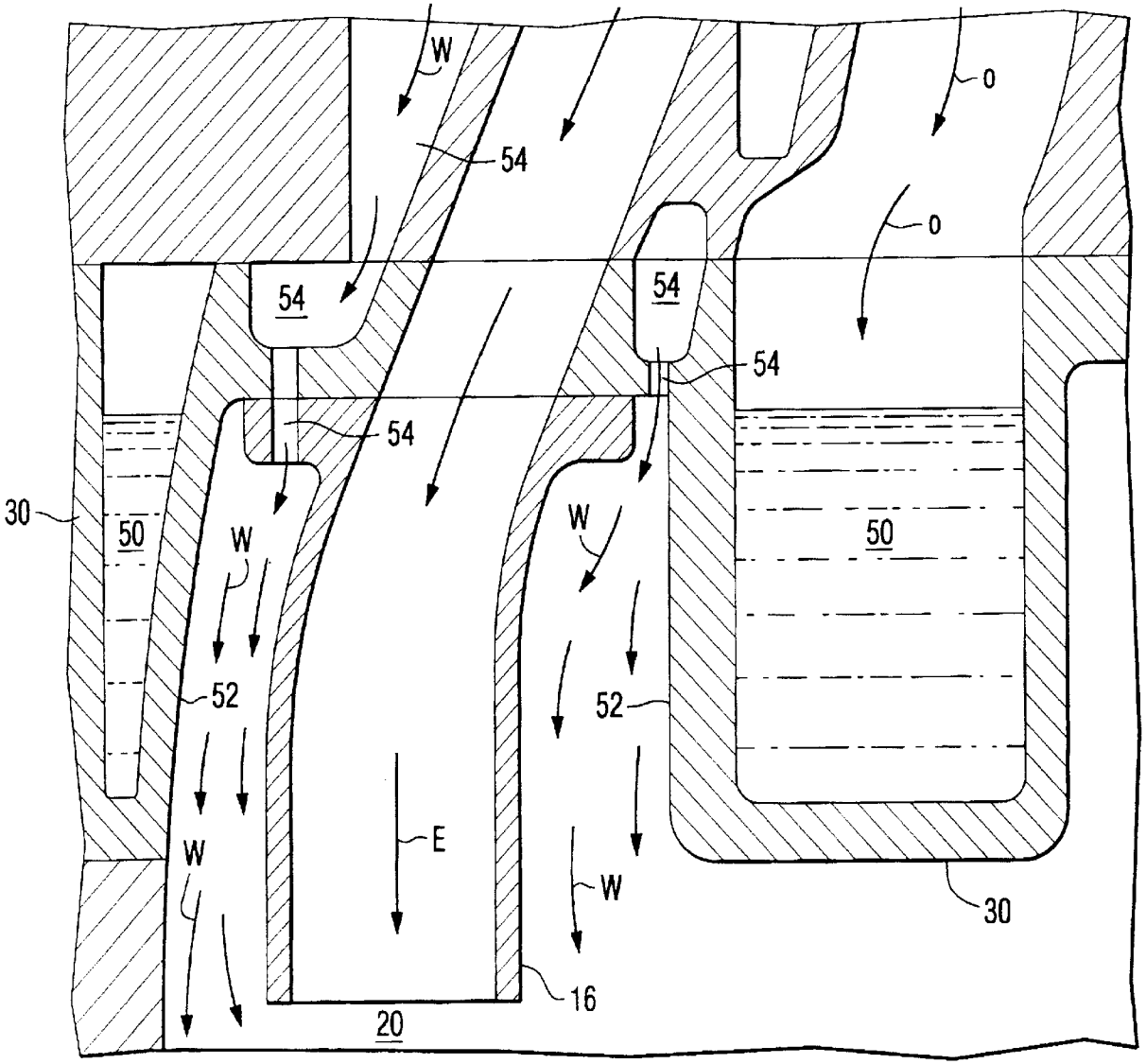
FIG. 2 PRIOR ART

FIG. 2 shows an alternative configuration of a known cooling system. In the illustration of FIG. 2, the exhaust gas passes downward from the internal combustion engine, as represented by arrows E, and flows into the expansion chamber 20. A reservoir of lubricating oil 50 is maintained in an oil pan 30. Arrows O represent the flow of oil back to the reservoir as the oil is recirculating from various lubricating locations. Cooling water flows, in the directions represented by arrows W, down from the internal combustion engine through various passages identified by reference numeral 54. These passages 54 combine to provide a conduit through which cooling water can pass from the internal combustion engine to the region of the exhaust pipe 16. By flowing in contact with the exhaust pipe 16, the cooling water reduces the temperature of the exhaust pipe 16 and is eventually mixed with the exhaust gases in the expansion chamber 20. Because of the geometry of the configuration shown in FIG. 2, some of the water can also flow in contact with the outer surface 52 of the oil pan 30.

Figure 3:
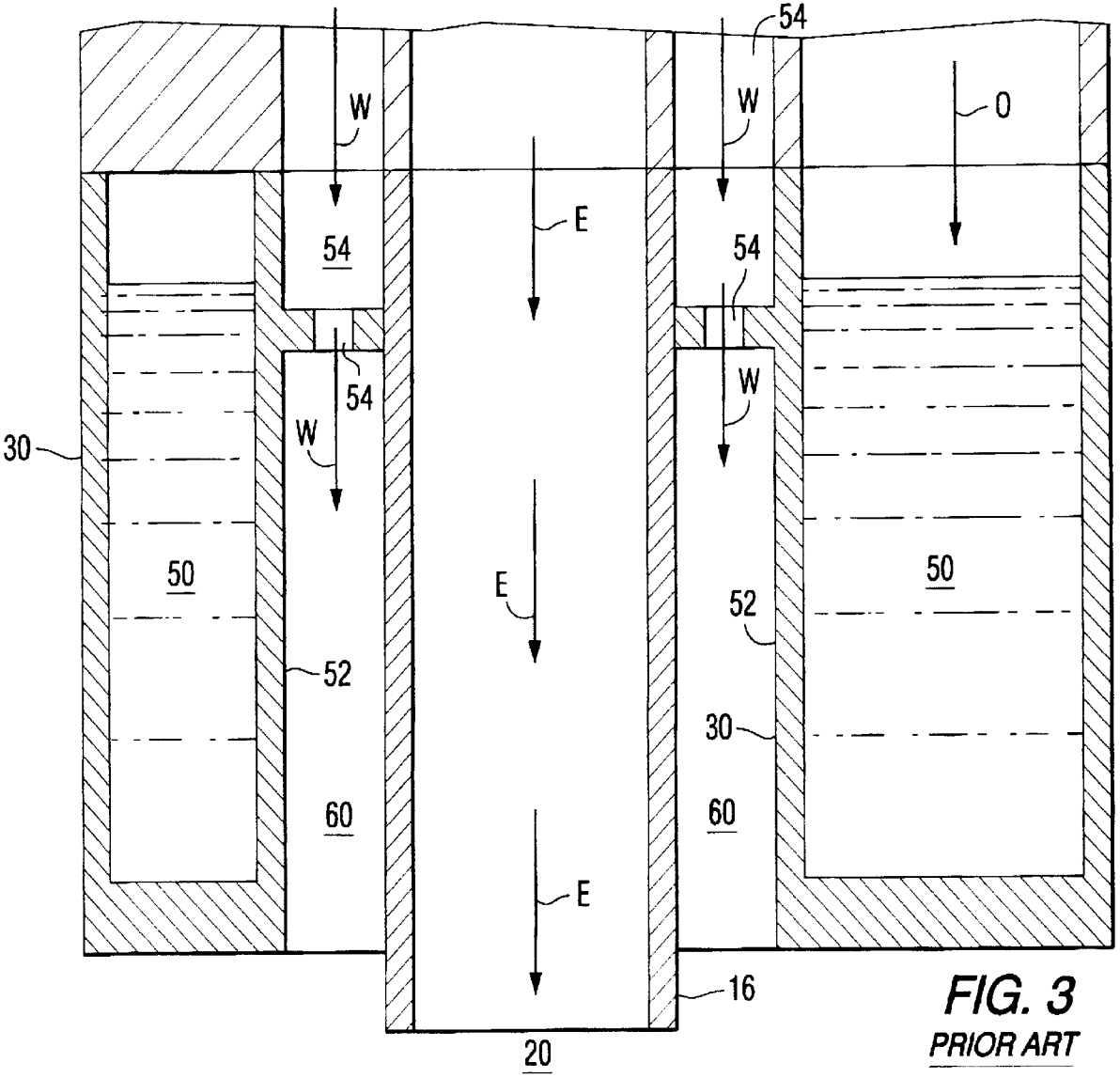
FIG. 3 PRIOR ART

FIG. 3 is a highly simplified schematic representation of the cooling system shown in FIG. 2. It is shown in a simplified representation for the purpose of facilitating the description below which will describe and illustrate two embodiments of the present invention. The known system shown in FIGS. 2 and 3 causes the cooling water to pass, as represented by arrows W, through the space 60 which is between the exhaust pipe 16 and the oil pan 30. The water passes through passages 54 and space 60 under the influence of both pressure, as it exits from the cooling circuit of the internal combustion engine, and gravity because of the physical configuration of the components of the outboard motor. As the water passes downward through space 60, its primary function is to cool the exhaust pipe 16. If the oil pan 30 is at an elevated temperature, the cooling water can also have the effect of lowering the temperature of the oil pan 30 and the oil 50 within it. However, because of the speed of the water and its transient existence within space 60, the overall thermal affect on the oil pan 30 is not optimal.

Figure 4:
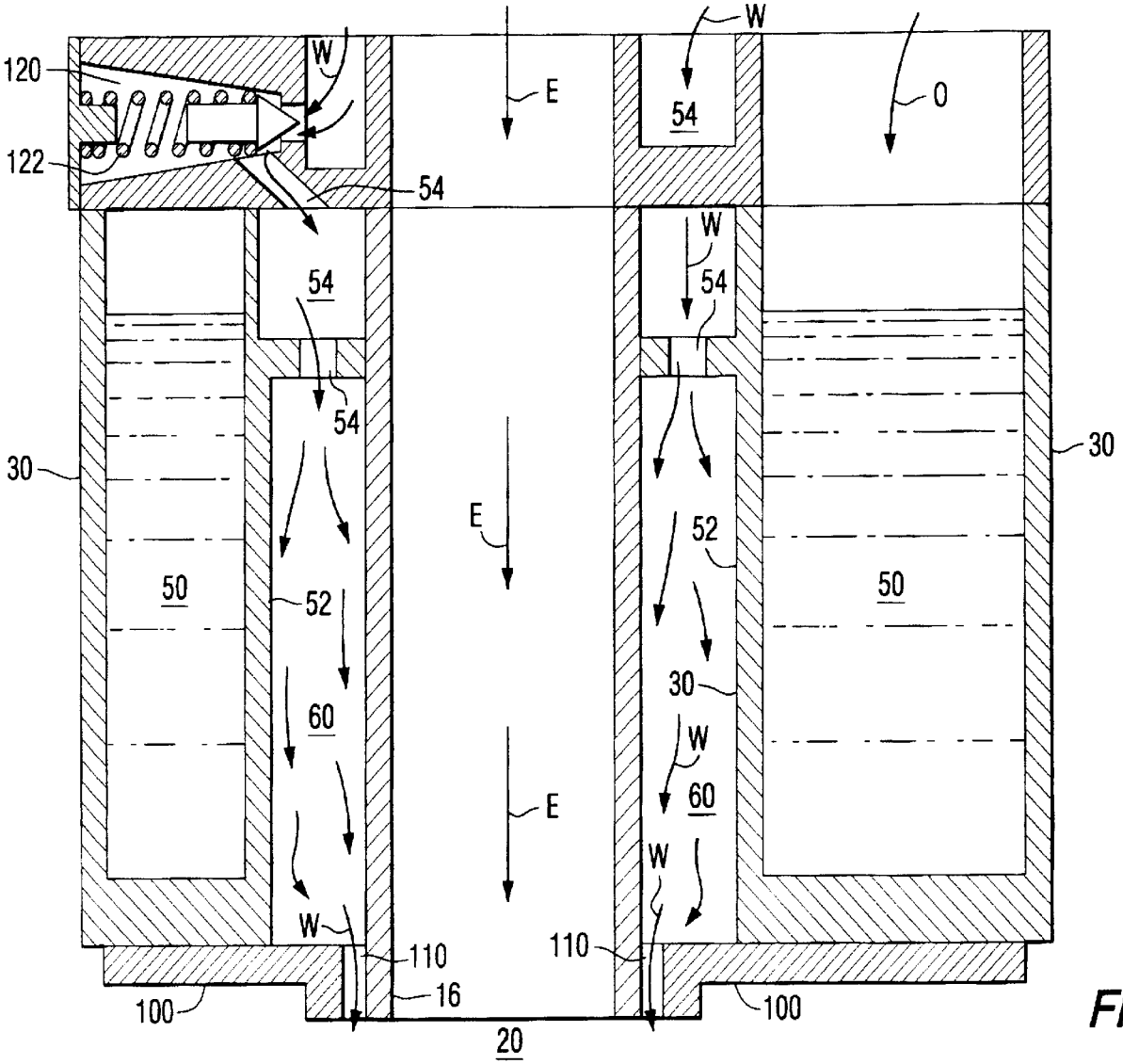
FIG. 4 shows a preferred embodiment of the present invention in a highly schematic representation.

FIG. 4 shows one preferred embodiment of the present invention. By comparing FIGS. 3 and 4, it can be seen that the embodiment of the present invention shown in FIG. 4 provides a flow restrictor 100 which is disposed downstream of at least a portion of the space 60. The purpose of the flow restrictor 100 is to slow the passage of the stream of water W as it passes through space 60. The presence of the flow restrictor 100 and its limited passage 110 induces the water to fill space 60 and maintain that filled status. If space 60 is filled with water that flows from the internal combustion engine, it will be in intimate thermal contact with the outer surface 52 of the oil pan 30. This will cause a more efficient transfer of heat between the oil 50 and the water passing through the space 60.

With continued reference to FIG. 4, a particularly preferred embodiment of the present invention incorporates a pressure activated valve 120 which responds to the pressure of the water flowing from the outlet of the water cooling circuit which passes through the engine block. If the pressure is insufficient to compress spring 122, water will not flow through passage 54. It should be noted that, when the pressure activated valve 120 is closed, the temperature of the oil 50 is not reduced by cooling water. Even though the cooling water has already passed through the engine block before flowing into thermal communication with the oil pan 30, in the arrangement provided by the present invention, inhibiting the cooling water from flowing through space 60 will further prevent any adverse overcooling of the oil 50. When the engine is running at higher speeds and higher pressures, the pressure controlled valve 120 is caused to open against the resistance of spring 122 and cooling water flows through passage 54 into space 60. When this occurs, the temperature of the oil pan 30 and oil 50 is moderated toward the temperature of the cooling water flowing from the outlet of the internal combustion engine. If the oil 50 is cold, the cooling water flowing from the outlet of the internal combustion engine will increase the temperature of the oil. Conversely, if the oil 50 is hot, the cooling water will reduce its temperature. The restrictor 100, with its reduced passage 110, causes the cooling water to slow as it flows through space 60 in order to increase this moderation of the oil temperature.

With continued reference to FIG. 4, it should be noted that the pressure activated valve 120 is not required in all embodiments of the present invention. In addition, it should also be noted that the reduced passage 110 is configured to be adjacent to the exhaust pipe 16 to maximize its cooling effect on the exhaust pipe 16 as it passes through the flow restrictor 100 and into the expansion chamber 20. It should also be noted that the illustration in FIG. 4 is a section view which does not show all of the water passages or the interconnections between the water passages 54 as the water flows from the engine to space 60.

With continuing reference to FIG. 4, it should be noted that the reduced passage 110 of the flow restrictor 100 could additionally be provided with a pressure activated valve (not shown) which prevents flow through the reduced passage 110 until the pressure within the space 60 exceeds a predetermined threshold magnitude. The pressure activated valve located at the reduced passage 110 would operate in a manner that is generally similar to the pressure activated valve 120 shown in FIG. 4. If located at the reduced passage 110 instead of its location shown in FIG. 4, the pressure activated valve would immediately allow the space 60 to fill with cooling water flowing from the outlet of the engine, but prevent the cooling water from leaving the space 60 until the predetermined pressure magnitude is exceeded.

Figure 5:
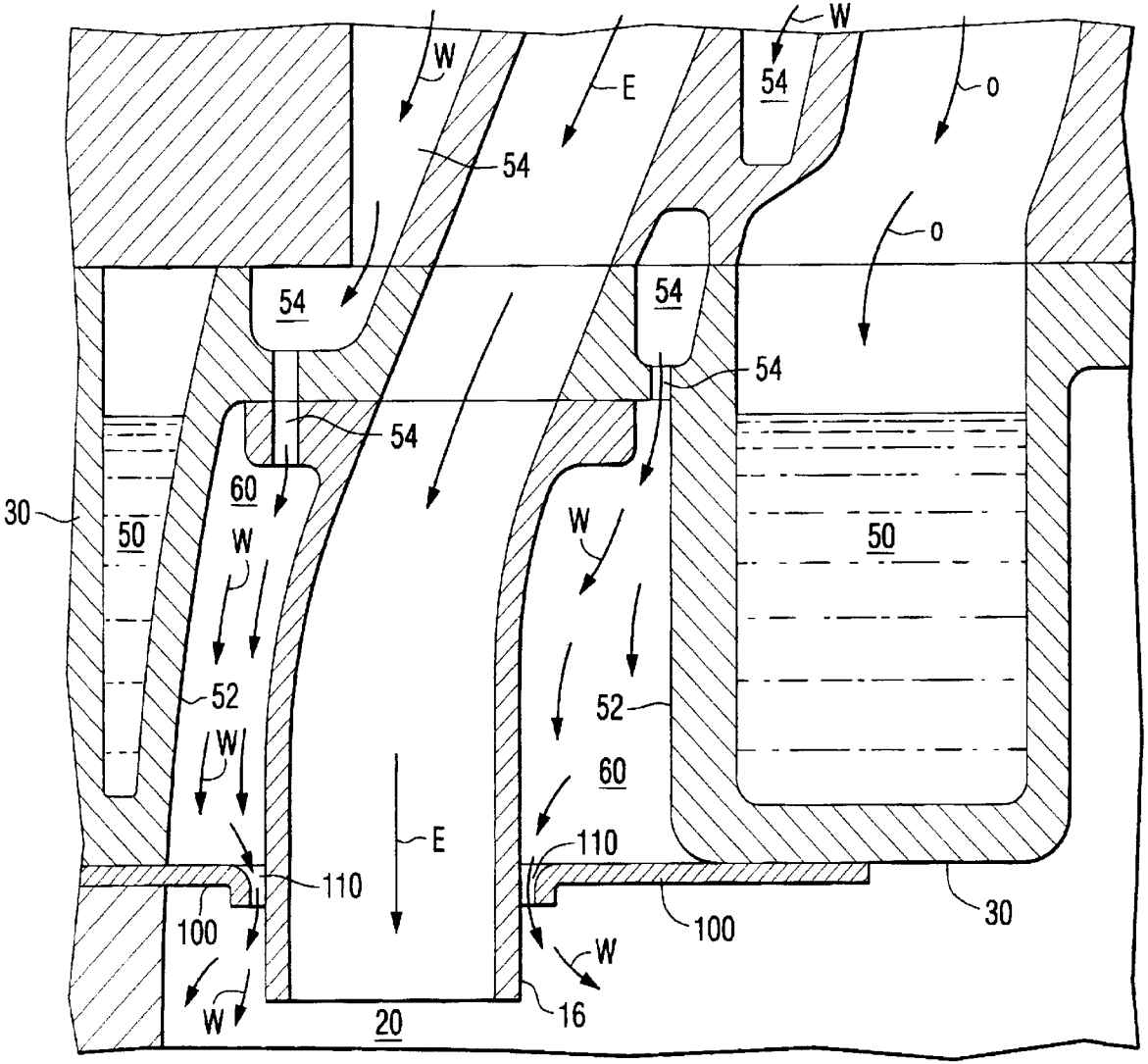
FIG. 5 shows the embodiment of FIG. 4, but without a pressure activated valve.

FIG. 5 shows an illustration of the present invention which is not as highly schematic as that represented in FIG. 4. In addition, the embodiment of the present invention shown in FIG. 5 does not incorporate the pressure activated valve 120. Instead, water is free to flow from the outlet of the internal combustion engine to the space 60 regardless of the pressure of the water as it exits the cooling system of the internal combustion engine. As described above, the water flows through passages 54 and into the space 60 which surrounds the exhaust pipe 16 and is surrounded by the oil pan 30. The restrictor 100 causes the water to slow as its flows downward through space 60 under the influence of pressure and gravity. This flow restrictor 100 causes the water to fill space 60 and remain in thermal communication with the outside surface 52 for a longer time during its passage. Eventually, the water flows from space 60 through reduced passage 110 and into the expansion chamber 20.

Figure 6:
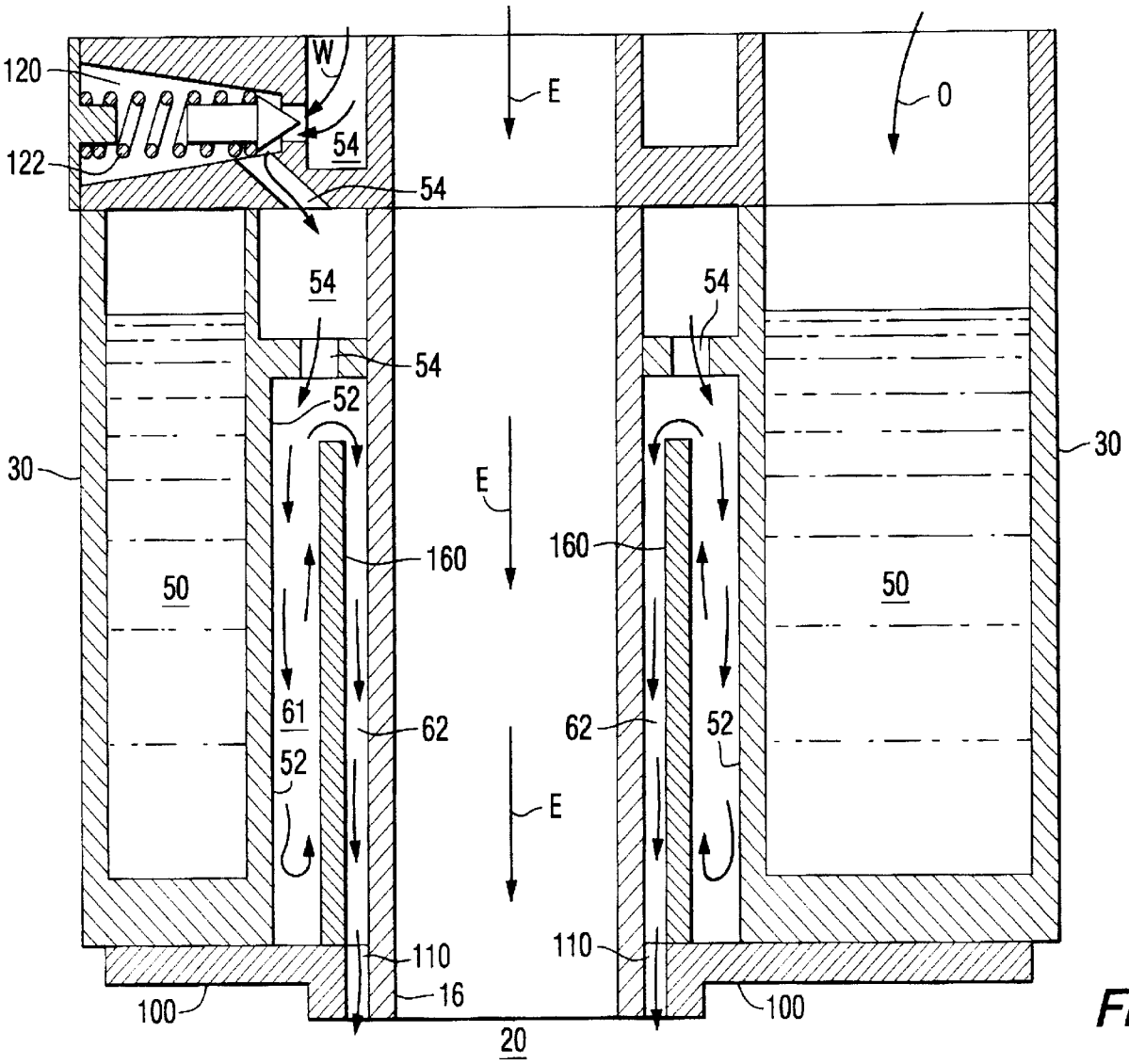
FIG. 6 shows an alternative embodiment of the present invention.

FIG. 6 shows an alternative embodiment of the present invention which provides a dam 160 which divides the space 60 into two portions. A first portion 61 collects water as it flows from the outlet of the internal combustion engine. The passages 54 are configured to cause the water to flow with a preference toward the first portion 61. A second portion 62 is connected more directly in fluid communication with the flow restrictor 100 and its reduced passages 110. It is intended for the water to flow from the passages 54 into the first portion 61 and then spill over into the second passage 62 prior to flowing out of the space and through reduced passage 110 of the restrictor 100. This embodiment of the present invention is intended to increase the thermal communication between the water and the space 60 and the inside surface 52 of the oil pan 30. It should be realized that this embodiment in FIG. 6 is shown in a highly schematic representation for the purpose of clearly illustrating the division of space 60 into the first portion 61 and the second portion 62. Furthermore, the passages 54 could be arranged to further encourage the water to flow first into the first passage 61 and then spill over into the second passage 62. In addition, it should be realized that the embodiment shown in FIG. 6 does not require the pressure activated valve 120 in all embodiments.

The primary purpose of the present invention is to moderate the temperature of the oil in the oil pan and maintain it within a preselected temperature range which is particularly conducive to efficient operation of the engine. Known cooling systems are typically directed toward cooling the oil in the oil pan, but are not responsive to the significant possibility that the oil in the oil pan may be below efficient operating temperatures under certain conditions. For example, during start-up, the oil in the oil pan might be significantly below its most efficient operating temperature range because of the intimate thermal contact of the driveshaft housing of the outboard motor with the body of water in which the marine vessel is operated. If the outboard motor, for example, is held low in the water to significantly submerge its driveshaft housing below the surface of a body of water, the temperature of the water may reduce the temperature of the oil in the oil pan below its most efficient operating temperature. This can raise the viscosity of the oil and significantly degrade the efficiency of the lubrication system. The present invention addresses this issue along with the issue of maintaining the oil in the oil reservoir below a maximum operating temperature. By using water after it passes from the outlet of the internal combustion engine, the potentially cold lake water is heated as it flows through the internal combustion engine and its temperature is raised sufficiently to prevent a chilling of the oil in the oil pan. In addition, the oil flowing from the outlet of the internal combustion engine is slowed as it flows through the space which is adjacent to the outer surface of the oil pan. Rather than allowing the water to flow swiftly under the influence of both gravity and pressure within the engine block, a flow restrictor is provided which slows the flow of the water as it passes through the space adjacent to the oil pan. This improves thermal communication between the cooling water and the outer surface of the oil pan. A pressure activated valve can be used to restrict the flow of cooling water from the engine into the space adjacent to the oil pan until the engine is operated at a sufficiently high pressure to overcome the restrictions of the pressure activated valve. It should be understood that the pressure activated valve is not necessary in all embodiments of the present invention. In addition, although one preferred embodiment of the present invention also provides a dam within the space adjacent to the outer surface of the oil pan, this dam is not required in all embodiments.

Although the present invention has been described with particular specificity to illustrate certain preferred embodiments and illustrated with particularity to show those embodiments it should be understood that alternative embodiments are also within its scope.

I claim:

1. An internal combustion engine, comprising:

a water cooling circuit extending through a portion of an engine block of said internal combustion engine;

an oil reservoir for holding a quantity of lubricating oil for use by said internal combustion engine;

an inlet of said water cooling circuit connected in fluid communication with a source of water;

an outlet of said water cooling circuit positioned to direct a stream of said water through a space which is adjacent to an outer surface of said oil reservoir after said water has passed through said engine block;

a flow restrictor disposed downstream of at least a portion of said space to slow the passage of said stream of water through said space; and a pressure relief valve disposed within said water cooling circuit to prevent water flow from said outlet unless the pressure of said water within said engine block is greater than a preselected magnitude.

2. The engine of claim 1, wherein:

said space is disposed between said oil reservoir and an exhaust gas conduit of said internal combustion engine.

3. The engine of claim 2, wherein:

said space is generally annular in shape and disposed around said exhaust gas conduit.

4. The engine of claim 3, wherein:

said oil reservoir is generally annular in shape and disposed around said space.

5. The engine of claim 2, wherein:

said flow restrictor comprises an opening which directs water to flow in thermal contact with said exhaust gas conduit as it leaves said space.

6. The engine of claim 1, wherein:

said pressure relief valve is disposed upstream from said space and between said space and said outlet.

7. The engine of claim 1, wherein:

said pressure relief valve is disposed downstream from said space, said space being between said outlet and said pressure relief valve.

8. The engine of claim 1, further comprising:

a dam disposed within said space to divide said space into first and second portions, said first portion collecting water flow from said outlet and spilling over into said second portion.

9. The engine of claim 8, wherein:

said second portion is connected in fluid communication between said first portion and said flow restrictor.

10. The engine of claim 1, wherein:

said internal combustion engine is a component of a marine propulsion device.

11. The engine of claim 10, wherein:

said marine propulsion device is an outboard motor.

12. An internal combustion engine, comprising:

a water cooling circuit extending through a portion of an engine block of said internal combustion engine;

an oil reservoir for holding a quantity of lubricating oil for use by said internal combustion engine;

an inlet of said water cooling circuit connected in fluid communication with a source of water;

an outlet of said water cooling circuit positioned to direct a stream of said water through a space which is adjacent to an outer surface of said oil reservoir after said water has passed through said engine block, said space is disposed between said oil reservoir and an exhaust gas conduit of said internal combustion engine;

a flow restrictor disposed downstream of at least a portion of said space to slow the passage of said stream of water through said space; and a pressure relief valve disposed within said water cooling circuit to prevent water flow from said outlet unless the pressure of said water within said engine block is greater than a preselected magnitude, said pressure relief valve being disposed upstream from said space and between said space and said outlet.

13. The engine of claim 12, wherein:

said space is generally annular in shape and disposed around said exhaust gas conduit.

14. The engine of claim 13, wherein:

said oil reservoir is generally annular in shape and disposed around said space.

15. The engine of claim 14, wherein:

said flow restrictor comprises an opening which directs water to flow in thermal contact with said exhaust gas conduit as it leaves said space.

16. The engine of claim 12, further comprising:

a dam disposed within said space to divide said space into first and second portions, said first portion collecting water flow from said outlet and spilling over into said second portion.

17. An internal combustion engine, comprising:

a water cooling circuit extending through a portion of an engine block of said internal combustion engine;

an oil reservoir for holding a quantity of lubricating oil for use by said internal combustion engine;

an inlet of said water cooling circuit connected in fluid communication with a source of water;

an outlet of said water cooling circuit positioned to direct a stream of said water through a space which is adjacent to an outer surface of said oil reservoir after said water has passed through said engine block, said space is disposed between said oil reservoir and an exhaust gas conduit of said internal combustion engine, said space being generally annular in shape and disposed around said exhaust gas conduit;

a flow restrictor disposed downstream of at least a portion of said space to slow the passage of said stream of water through said space;

a pressure relief valve disposed within said water cooling circuit to prevent water flow from said outlet unless the pressure of said water within said engine block is greater than a preselected magnitude, said pressure relief valve being disposed upstream from said space and between said space and said outlet; and a dam disposed within said space to divide said space into first and second portions, said first portion collecting water flow from said outlet and spilling over into said second portion.

* * * * *